US008043044B2

(12) United States Patent
Hudson et al.

(10) Patent No.: US 8,043,044 B2
(45) Date of Patent: Oct. 25, 2011

(54) LOAD PIN FOR COMPRESSOR SQUARE BASE STATOR AND METHOD OF USE

(75) Inventors: Michael Thomas Hudson, Greenville, SC (US); John Robert Sech, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 600 days.

(21) Appl. No.: 12/208,965

(22) Filed: Sep. 11, 2008

(65) Prior Publication Data

US 2010/0061844 A1 Mar. 11, 2010

(51) Int. Cl.
*F04D 29/60* (2006.01)

(52) U.S. Cl. ..... 415/1; 415/209.3; 415/209.4

(58) Field of Classification Search ..... 415/1, 209.3, 415/209.4

See application file for complete search history.

(56) References Cited

U.S. PATENT DOCUMENTS

| | | | | |
|---|---|---|---|---|
| 2,567,586 | A | 9/1951 | Werder | |
| 3,996,670 | A | 12/1976 | Joyal et al. | |
| 3,997,280 | A * | 12/1976 | Germain | 415/189 |
| 4,009,969 | A * | 3/1977 | Kadera et al. | 415/209.3 |
| 4,056,888 | A | 11/1977 | Hughey, Jr. | |
| 4,146,967 | A | 4/1979 | Rohner et al. | |
| 4,395,827 | A | 8/1983 | Stowe et al. | |
| 4,411,073 | A | 10/1983 | Ryan | |
| 4,428,126 | A | 1/1984 | Banks | |
| 4,642,901 | A | 2/1987 | Webb | |
| 4,890,978 | A * | 1/1990 | McLaurin et al. | 415/209.4 |
| 5,031,335 | A | 7/1991 | Kimmelman | |
| 5,141,394 | A * | 8/1992 | Donlan | 415/190 |
| 5,141,395 | A * | 8/1992 | Carroll et al. | 415/196 |
| 5,152,070 | A | 10/1992 | Sorokes | |
| 5,152,071 | A | 10/1992 | Bergeron | |
| 5,211,537 | A * | 5/1993 | Langston et al. | 415/209.2 |
| 5,224,825 | A * | 7/1993 | Strang et al. | 415/209.3 |
| 5,399,069 | A * | 3/1995 | Marey et al. | 415/209.3 |
| 5,411,370 | A * | 5/1995 | Varsik | 415/209.4 |
| 5,618,161 | A * | 4/1997 | Papageorgiou et al. | 415/190 |
| 5,628,119 | A | 5/1997 | Bingham et al. | |
| 5,690,469 | A * | 11/1997 | Deal et al. | 415/189 |
| 5,765,993 | A * | 6/1998 | Weiss | 415/209.2 |
| 5,993,160 | A | 11/1999 | Bouchard et al. | |
| 6,381,908 | B1 | 5/2002 | Fisher | |
| 6,457,913 | B1 | 10/2002 | Garten | |
| 6,655,911 | B2 * | 12/2003 | Bekrenev | 415/116 |
| 6,843,638 | B2 * | 1/2005 | Hidalgo et al. | 415/209.3 |
| 6,860,028 | B2 | 3/2005 | Charest et al. | |
| 6,886,267 | B1 | 5/2005 | Karwowski et al. | |
| 6,895,684 | B1 | 5/2005 | Firth | |
| 6,935,041 | B2 | 8/2005 | Orton | |
| 6,942,453 | B2 * | 9/2005 | Tsuru et al. | 415/209.4 |
| 6,984,108 | B2 * | 1/2006 | Anderson et al. | 415/209.3 |
| 7,101,150 | B2 * | 9/2006 | Bash et al. | 415/191 |
| 7,152,338 | B2 | 12/2006 | Thompson et al. | |
| 7,185,875 | B1 | 3/2007 | Jarrett | |
| 7,396,206 | B2 * | 7/2008 | Humhauser | 415/209.3 |
| 7,507,069 | B2 * | 3/2009 | Kizuka et al. | 415/199.5 |
| 7,571,551 | B1 | 8/2009 | Anderson | |
| 7,686,571 | B1 * | 3/2010 | Matheny | 415/9 |

(Continued)

*Primary Examiner* — George Fourson, III
(74) *Attorney, Agent, or Firm* — Cantor Colburn LLP

(57) ABSTRACT

A load pin has an end portion, and a vane has a base with a cutout in the base, wherein the end portion of the load pin engages a wall portion of the cutout in the base of the vane, thereby inhibiting any movement of the vane in a particular direction.

13 Claims, 3 Drawing Sheets

U.S. PATENT DOCUMENTS

2009/0180858 A1* 7/2009 Tapper ..... 415/1
2009/0223073 A1 9/2009 Tu
2010/0254804 A1* 10/2010 Harper ..... 415/119

* cited by examiner

LOAD PIN FOR COMPRESSOR SQUARE BASE STATOR AND METHOD OF USE

BACKGROUND OF THE INVENTION

The subject matter disclosed herein relates to gas turbine engines and, more particularly, to a load pin for use in conjunction with a cutout formed in the bottom of a square base vane to lock the vane in place within the compressor case of a gas turbine engine.

A number of square base stator vanes or airfoils are typically loaded circumferentially into a compressor casing through a cutout in the casing. Due to the aerodynamic loads on the airfoils, the stators are commonly loaded into the casing in the counter-clockwise (CCW) direction, as viewed forward looking aft (FLA). Since these stators are essentially stacked up circumferentially without any of the stators being locked in place within the casing by any separate physical means, the cumulative aerodynamic load also increases in the CCW direction. Currently, there is no limit to the number of vanes that load up in either half of the casing. That is, all of the stator vanes in the upper casing half will load up on the vane at the upper casing half left hand joint (as viewed FLA). Similarly, all of the vanes in the lower casing half will load up on the vane at the lower casing half right hand joint (as viewed FLA). Strain gage test data on the stator vanes shows that the vibratory responses are highest at the vanes with the highest cumulative load. For the upper half of the compressor casing, this is the vane at the left hand joint between the upper and lower casing halves (9 o'clock position, as viewed FLA). The lowest vibratory responses are at the vanes with the lowest cumulative load. For the upper half of the compressor casing, this is the vane at the right hand joint between the upper and lower casing halves (3 o'clock position, as viewed FLA). Furthermore, it has been shown that the vibratory response levels increase linearly in the CCW direction.

BRIEF DESCRIPTION OF THE INVENTION

According to one aspect of the invention, a load pin has an end portion, and a vane has a base with a cutout in the base, wherein the end portion of the load pin engages a wall portion of the cutout in the base of the vane, thereby inhibiting any movement of the vane in a particular direction.

According to another aspect of the invention, a load pin having an end portion is provided; a vane having a base with a cutout in the base is provided; and the load pin is located through a wall of a casing, wherein the end portion of the load pin engages a wall portion of the cutout in the base of the vane, thereby inhibiting any movement of the vane in a particular direction.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
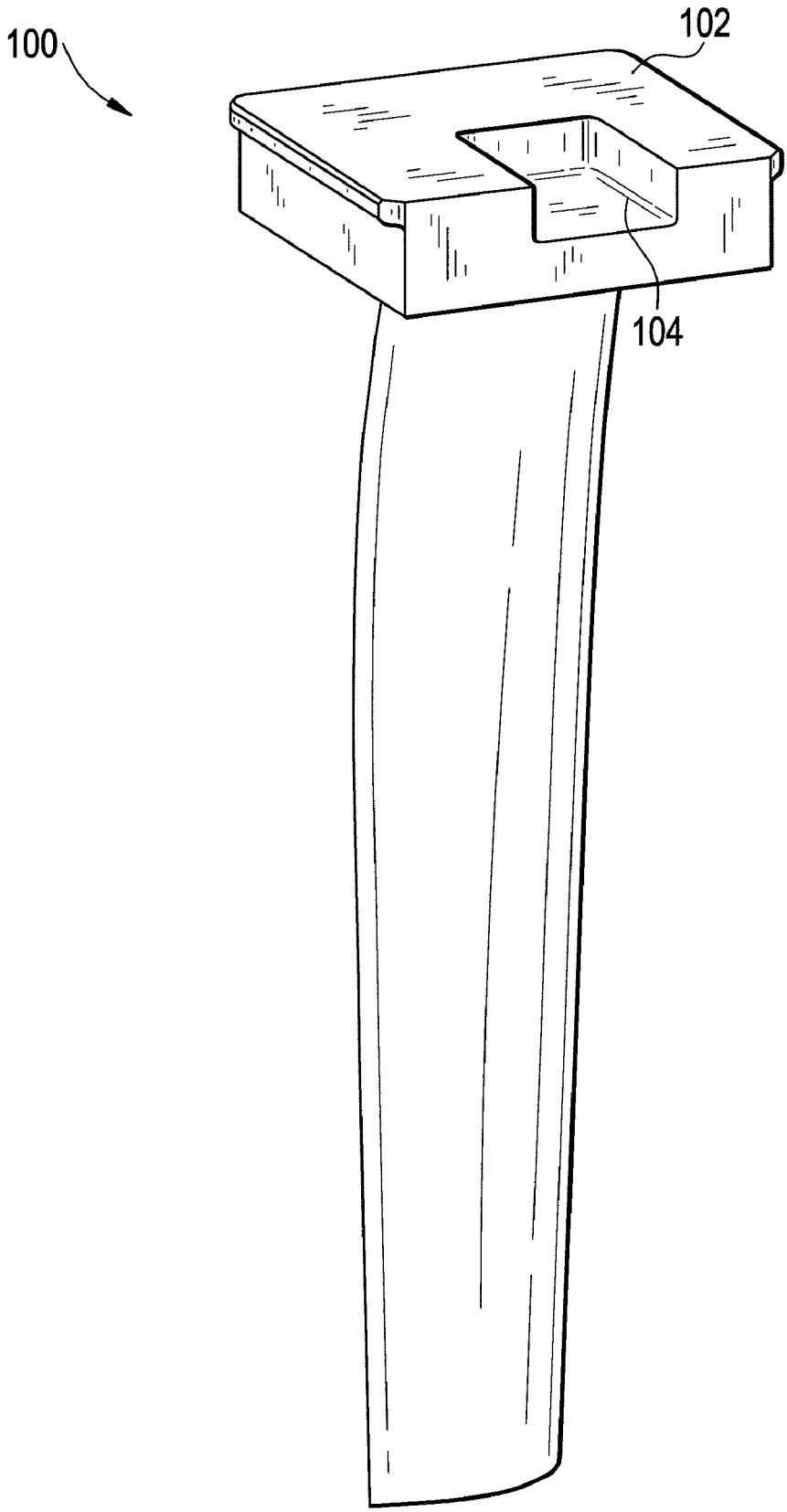
FIG. 1 is a perspective view of a vane having a square base with a cutout in accordance with an embodiment of the invention.

Referring to FIG. 1, there illustrated in perspective is a vane 100 (e.g., a stator vane or other type of vane) having a base portion 102 with a square shape. In accordance with an embodiment of the invention, the base 102 has a cutout 104 formed therein, wherein the cutout 104 is in the shape of a square or rectangle. However, other shapes for the stator base 102 and other shapes for the cutout 104 are contemplated by embodiments of the invention.

Figure 2:
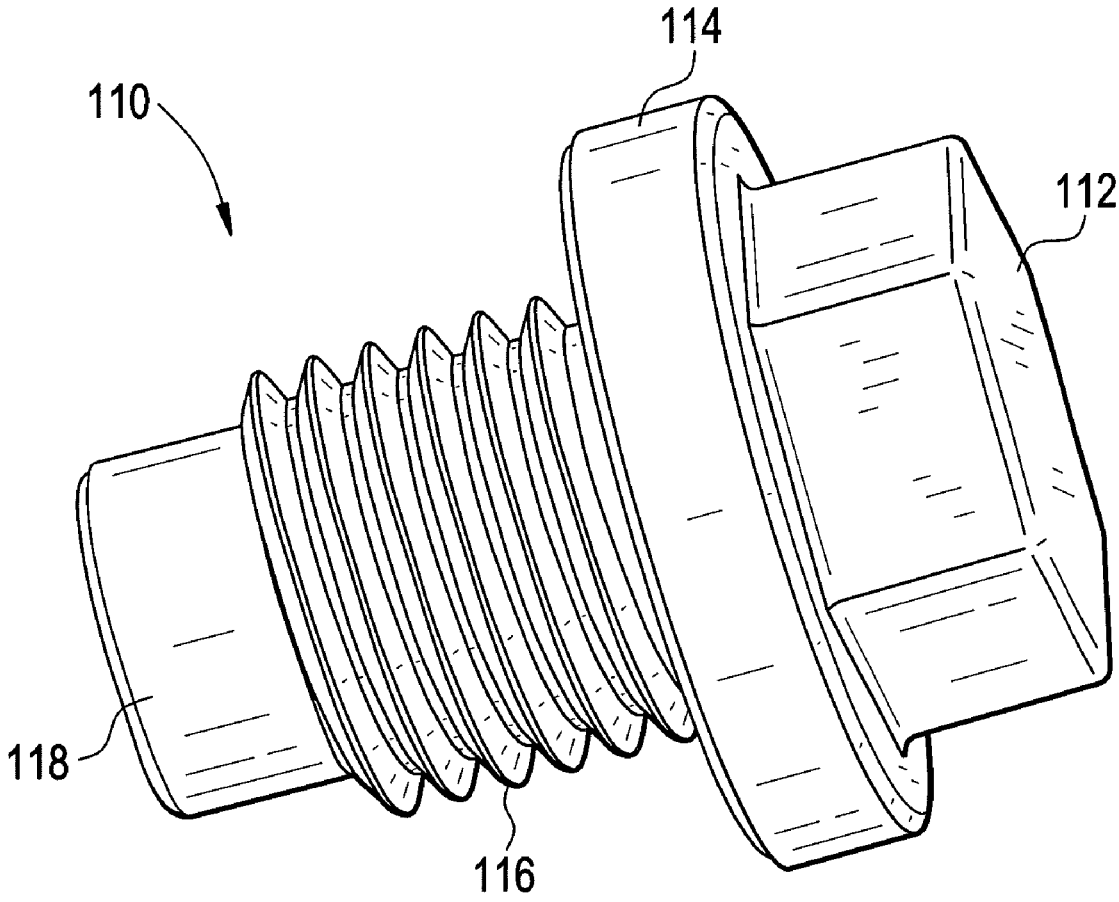
FIG. 2 is a perspective view of a load pin in accordance with an embodiment of the invention.

Referring to FIG. 2, there illustrated in perspective is a load pin 110 in accordance with an embodiment of the invention. The pin 110 includes a hex head 112, a flange 114, a threaded portion 116, and an end portion 118 with a smooth outer surface with no Paragraph number is screwed up here threads. However, other shapes for the pin 110 and other shapes for the head 112, flange 114, threaded portion 116, and end portion 118 are contemplated by embodiments of the invention.

Figure 3:
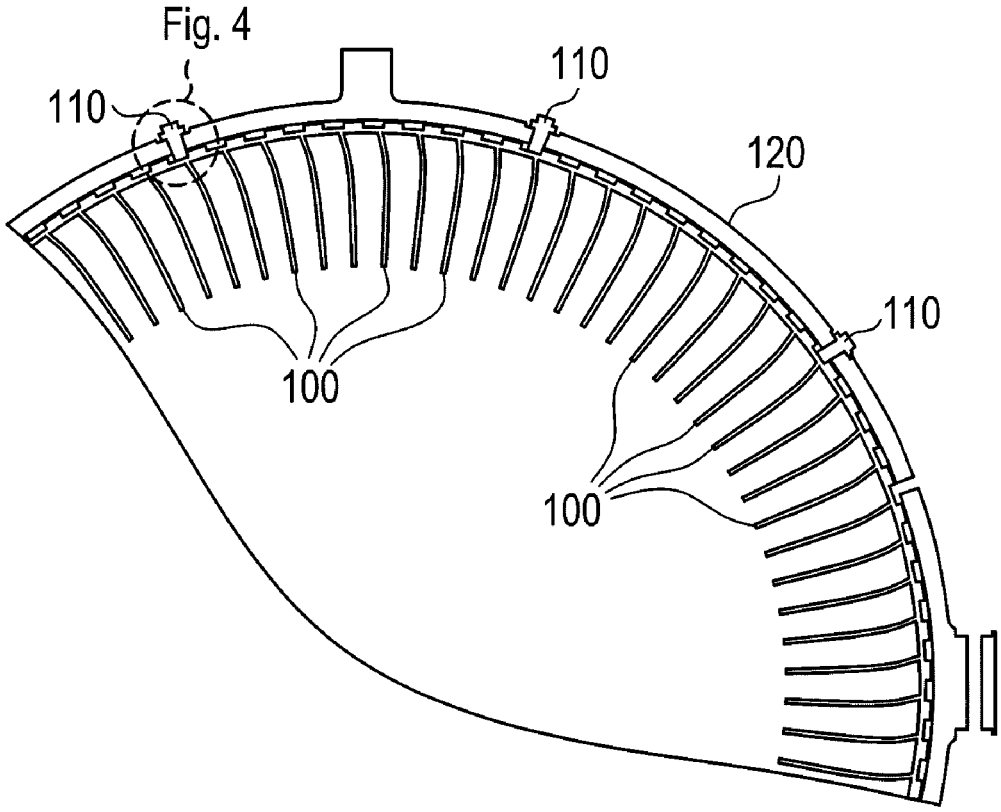
FIG. 3 is front view (forward looking aft) of a compressor casing having a plurality of the vanes of FIG. 1 with periodic ones of the vanes being locked in place by the load pin of FIG. 2.
Figure 4:
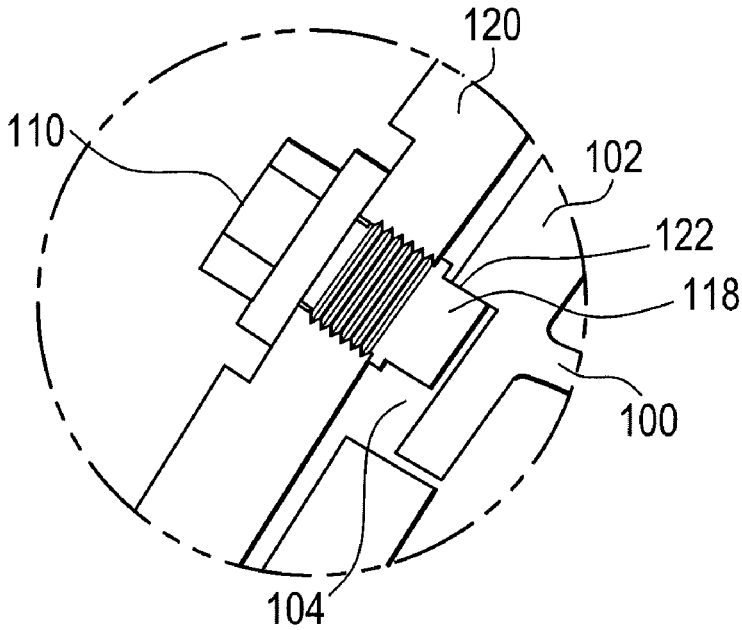
FIG. 4 is a more detailed view of the load pin of FIG. 2 engaging a vane of FIG. 1 through the compressor casing to thereby lock the vane in place within the compressor casing.

Referring to FIG. 3, there illustrated is a portion of a casing 120 of a compressor that may be a part of a gas turbine engine. The casing 120 of FIG. 3 is illustrated with a plurality of the stator vanes 100 of FIG. 1 loaded circumferentially within a groove located within the inner surface of the casing 120. Typically the casing 120 is divided into an upper half and a lower half and the stator vanes 100 are loaded into each half of the compressor casing 120 in a counter-clockwise (CCW) direction. However, stator vanes 100 which are loaded into each half of the compressor casing 120 in the clockwise (CW) direction instead, are also contemplated by embodiments of the invention. FIG. 3 also illustrates several of the load pins 110 spaced apart at certain radial locations around the outer circumference of the casing 120. At these locations around the casing 120, each load pin 110 is threaded into a corresponding hole in the casing 120 to secure the pin 110 to the casing while the end portion 118 of the load pin 110 protrudes inside the casing 120 and engages the cutout 104 in the base 102 of the stator vane 100. This can be seen more clearly in FIG. 4, which shows how the end portion 118 of the load pin 110 engages a wall portion 122 of the cutout 104 and thereby mechanically prevents any CCW movement of the stator vane 100 within the compressor casing 120 beyond the load pin 110. The locked stator vane 100 in accordance with an embodiment of the invention also inhibits any movement of the stator vanes 100 that are located in back of the locked vane 100 (viewed clockwise from the locked vane 100 in the forward looking aft direction of FIG. 3) as these vanes are loaded up behind the locked stator vane 100.

As seen in FIG. 3, by using a number of load pins 110 to lock corresponding stator vanes 100 in place within the compressor casing 100 at spaced apart locations around the circumference of the casing 120 within each half of the casing

120, the aerodynamic circumferential loading of the stator vanes 100 in both the upper and lower halves of the compressor casing 120 is reduced. This is because now the stator vanes 100 within the upper half of the casing 120 and the stator vanes 100 within the lower half of the casing 120 do not all load up behind each other anymore in the entirety within each casing half, as in the prior art described above. Instead, a smaller number of vanes 100 now load up behind each other in each casing half, thereby reducing the aerodynamic circumferential loading of the stator vanes 100. Embodiments of the invention have the further benefit that the load pin 110 and stator vane cutout 104 features can be retrofitted onto existing compressor stator vanes 100 in the field and these features are not limited to new gas turbine engines being assembled in the factory.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus, comprising:

a load pin having an end portion;

a vane having a base with a cutout in the base, wherein the end portion of the load pin engages a wall portion of the cutout in the base of the vane, thereby inhibiting any movement of the vane in a particular direction; and a circumferential casing, wherein a plurality of the vanes are disposed adjacent an inner periphery of the casing, wherein a plurality of the load pins are disposed through a wall of the casing at periodic radial locations, and wherein the end portion of each of the plurality of the load pins engages the wall portion of the cutout in the base of the corresponding vane at each periodic radial location of the load pins to lock the corresponding vane in position and prevent any movement of the corresponding locked vane and any movement of other ones of the vanes disposed next to the locked vane along the inner periphery of the casing in a particular direction until the next locked vane is encountered.

2. The apparatus of claim 1, wherein the load pin is disposed through a wall of a casing.

3. The apparatus of claim 1, wherein the casing comprises a portion of a compressor for a gas turbine engine.

4. The apparatus of claim 3, wherein the load pin is threaded through a wall of the compressor.

5. The apparatus of claim 1, wherein each of the load pins is threaded through the wall of the casing.

6. A method, comprising:

providing a load pin having an end portion;

providing a vane having a base with a cutout in the base;

locating the load pin through a wall of a circumferential casing, wherein the end portion of the load pin engages a wall portion of the cutout in the base of the vane, thereby inhibiting any movement of the vane in a particular direction; and disposing a plurality of the vanes adjacent an inner periphery of the circumferential casing, wherein a plurality of the load pins are disposed through a wall of the casing at periodic radial locations, and wherein the end portion of each of the plurality of the load pins engages the wall portion of the cutout in the base of the corresponding vane at each periodic radial location of the load pins to lock the corresponding vane in position and prevent any movement of the corresponding locked vane and any movement of other ones of the vanes disposed next to the locked vane along the inner periphery of the casing in a particular direction until the next locked vane is encountered.

7. The method of claim 6, wherein locating the load pin through the wall of the casing further comprises threading the load pin through the wall of the casing.

8. The method of claim 6, wherein the casing is circular.

9. An apparatus, comprising:

a casing;

a plurality of load pins each having an end portion, wherein the plurality of load pins are disposed at predetermined radial locations around the circumference of the casing; and a plurality of vanes disposed around an inner periphery of the casing, wherein each vane has a base with a cutout in the base, wherein the end portion of each load pin engages a wall portion of the cutout in the base of the corresponding one of the vanes, thereby inhibiting any movement of the corresponding vane in a particular direction, wherein the plurality of vanes is greater than the plurality of load pins.

10. The apparatus of claim 9, wherein each load pin is disposed through a wall of the casing.

11. The apparatus of claim 9, wherein each load pin is threaded through a wall of the casing.

12. The apparatus of claim 9, wherein the casing comprises a casing of a compressor of a gas turbine engine.

13. The apparatus of claim 9, wherein when the end portion of each load pin engages a wall portion of the cutout in the base of the corresponding one of the vanes the vane is in a locked position, thereby inhibiting any movement of the corresponding vane in the locked position and any movement of other ones of the vanes disposed circumferentially next to the vane in the locked position along the inner periphery of the casing in a particular direction until the next vane in the locked position is encountered in the particular direction, thereby reducing an aerodynamic loading on the vanes.

* * * * *